US012188474B2

(12) United States Patent
Yoshida et al.

(10) Patent No.: US 12,188,474 B2
(45) Date of Patent: Jan. 7, 2025

(54) ROOTS PUMP

(71) Applicant: KABUSHIKI KAISHA TOYOTA JIDOSHOKKI, Kariya (JP)

(72) Inventors: Masaya Yoshida, Kariya (JP); Daisuke Masaki, Kariya (JP); Ryosuke Fukuyama, Kariya (JP); Katsutoshi Shiromaru, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 18/582,025

(22) Filed: Feb. 20, 2024

(65) Prior Publication Data

US 2024/0287986 A1 Aug. 29, 2024

(30) Foreign Application Priority Data

Feb. 24, 2023 (JP) ..... 2023-027069

(51) Int. Cl.
*F04C 2/12* (2006.01)

(52) U.S. Cl.
CPC ..... *F04C 2/126* (2013.01); *F04C 2230/20* (2013.01); *F04C 2240/20* (2013.01); *F04C 2240/30* (2013.01); *F04C 2240/50* (2013.01); *F04C 2240/60* (2013.01)

(58) Field of Classification Search
CPC ..... F02B 33/38; F04C 18/18; F04C 23/02
See application file for complete search history.

(56) References Cited

U.S. PATENT DOCUMENTS 10,215,186 B1 * 2/2019 Wagner ..... F04D 29/4206

FOREIGN PATENT DOCUMENTS

| | | | |
|---|---|---|---|
| JP | 59-165987 U | | 11/1984 |
| JP | H01187391 A | * | 7/1989 |
| JP | 10-220374 A | | 8/1998 |
| JP | 2002-195182 A | | 7/2002 |
| JP | 2009-287580 A | | 12/2009 |

OTHER PUBLICATIONS

English Machine Translation of JP-H01187391-A (Year: 1989).*

* cited by examiner

*Primary Examiner* — Anthony Ayala Delgado
(74) *Attorney, Agent, or Firm* — Sughrue Mion, PLLC

(57) ABSTRACT

A roots pump comprising: a rotary shaft; a rotor having a hole-forming surface that forms an insertion hole, and a first bearing and a second bearing. Each of the first bearing and the second bearing includes an inner ring and an outer ring. The rotary shaft is press-fitted in the inner ring of the first bearing, and fitted in the inner ring of the second bearing with a clearance between the rotary shaft and the inner ring of the second bearing. An edge portion of the hole-forming surface adjacent to the first bearing serves as a press-fitting portion in which the rotary shaft is press-fitted, and at least an edge portion of the hole-forming surface adjacent to the second bearing serves as a clearance-fitting portion in which the rotary shaft is fitted with a clearance between the rotary shaft and the clearance-fitting portion.

7 Claims, 6 Drawing Sheets

ROOTS PUMP

CROSS-REFERENCE TO RELATED APPLICATION

This application claims priority to Japanese Patent Application No. 2023-027069 filed on Feb. 24, 2023, the entire disclosure of which is incorporated herein by reference.

The present disclosure relates to a roots pump.

BACKGROUND ART

A roots pump includes a housing, a rotor chamber, a rotary shaft, and a rotor. The housing has a suction hole and a discharge hole. A fluid is introduced through the suction hole. The fluid is discharged through the discharge hole. The rotor chamber is formed in the housing. The rotor chamber is connected to the suction hole and the discharge hole. The rotary shaft is disposed in the housing. The rotor has an insertion hole through which the rotary shaft is inserted and a hole-forming surface that forms the insertion hole. The rotor rotates, in the rotor chamber, together with the rotary shaft press-fitted in the hole-forming surface. That is, the hole-forming surface has a press-fitting portion in which the rotary shaft is press-fitted. The rotation of the rotor causes the fluid to be introduced to the rotor chamber through the suction hole and discharged from the rotor chamber through the discharge hole.

Japanese Utility Model Application Publication No. S59-165987 discloses a known roots pump that includes a first bearing and a second bearing supporting the rotary shaft respectively on the opposite sides of the rotor so that the rotary shaft is rotatable relative to the housing. The first bearing and the second bearing each include an inner ring, an outer ring, and a rolling element. The outer ring surrounds the inner ring and is supported by the housing. The rolling element is disposed between the inner ring and the outer ring. The rotary shaft is press-fitted in the inner ring of the first ring and fitted in the inner ring of the second bearing with a clearance between the rotary shaft and the inner ring of the second bearing, for example.

While such a roots pump is driven, the housing, the rotor, and the rotary shaft are affected by heat. The housing may thermally expand in the axial direction of the rotary shaft from the press-fitting area of the inner ring of the first bearing in which the rotary shaft is press-fitted. Since the rotary shaft is fitted in the inner ring of the second bearing with a clearance between the rotary shaft and the inner ring, thermal expansion of the housing in the axial direction of the rotary shaft is not constrained at a position between the second bearing and the rotary shaft. This prevents a load from being applied on the second bearing when the housing thermally expands in the axial direction of the rotary shaft.

The rotor and the rotary shaft thermally expand in the axial direction of the rotary shaft, so that the rotor is displaced in the axial direction of the rotary shaft. Since the rotary shaft is press-fitted in the hole-forming surface, the amount of displacement of the rotor due to the thermal expansion depends on the thermal expansion of the rotary shaft in the axial direction of the rotary shaft. A region where the rotor thermally expands in the axial direction of the rotary shaft depending on the thermal expansion of the rotary shaft extends with an increase in the distance between the press-fitting area of the inner ring of the first bearing in which the rotary shaft is press-fitted and the press-fitting portion of the hole-forming surface in which the rotary shaft is press-fitted.

For example, the coefficient of linear expansion of the material of the housing and the coefficient of linear expansion of the material of the rotor may be larger than the coefficient of linear expansion of the material of the rotary shaft. This increases the difference between the displacement amount of the housing and the displacement amount of the rotor in the axial direction of the rotary shaft due to the thermal expansion. This therefore may cause an excessive increase in the clearance between the rotor and the housing or a contact of the rotor with the housing.

In order to prevent the rotor from coming into contact with the housing, it is necessary to increase the clearance between the rotor and the housing. However, an excessive increase in the clearance between the rotor and the housing decreases the performance of the roots pump. Accordingly, it is desirable to increase the performance of the roots pump.

The present disclosure, which has been made in light of the above-mentioned problem, is directed to providing a roots pump that has an increased performance.

SUMMARY

In accordance with an aspect of the present disclosure, there is provided a roots pump comprising: a housing; a rotor chamber; a rotary shaft; a rotor; and a first bearing and a second bearing. The housing has a suction hole through which a fluid is introduced and a discharge hole through which the fluid is discharged. The rotor chamber is formed in the housing and connected to the suction hole and the discharge hole. The rotary shaft is disposed in the housing. The rotor has an insertion hole through which the rotary shaft is inserted and a hole-forming surface that forms the insertion hole. The rotor is configured to rotate, in the rotor chamber, together with the rotary shaft press-fitted in the hole-forming surface. The first bearing and the second bearing support the rotary shaft respectively on opposite sides of the rotor so that the rotary shaft is rotatable relative to the housing. Each of the first bearing and the second bearing include: an inner ring; an outer ring surrounding the inner ring and supported by the housing; and a rolling element disposed between the inner ring and the outer ring. The rotary shaft is press-fitted in the inner ring of the first bearing, and fitted in the inner ring of the second bearing with a clearance between the rotary shaft and the inner ring of the second bearing. A coefficient of linear expansion of a material of the housing and a coefficient of linear expansion of a material of the rotor are larger than a coefficient of linear expansion of a material of the rotary shaft. A rotation of the rotor causes the fluid to be introduced to the rotor chamber through the suction hole and discharged from the rotor chamber through the discharge hole. An edge portion of the hole-forming surface adjacent to the first bearing serves as a press-fitting portion in which the rotary shaft is press-fitted. At least an edge portion of the hole-forming surface adjacent to the second bearing serves as a clearance-fitting portion in which the rotary shaft is fitted with a clearance between the rotary shaft and the clearance-fitting portion.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

Figure 1:
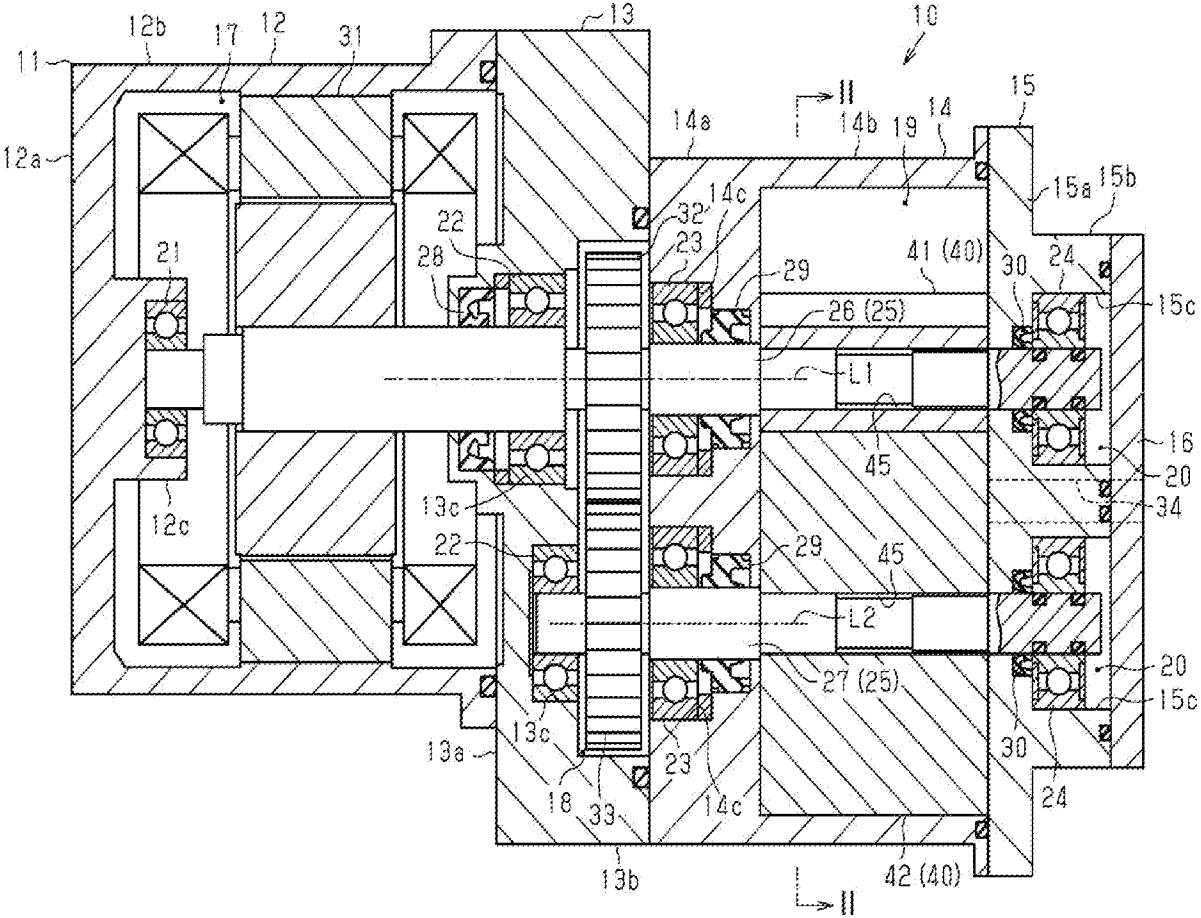
FIG. 1 is a cross-sectional view of a roots pump according to an embodiment.
Figure 2:
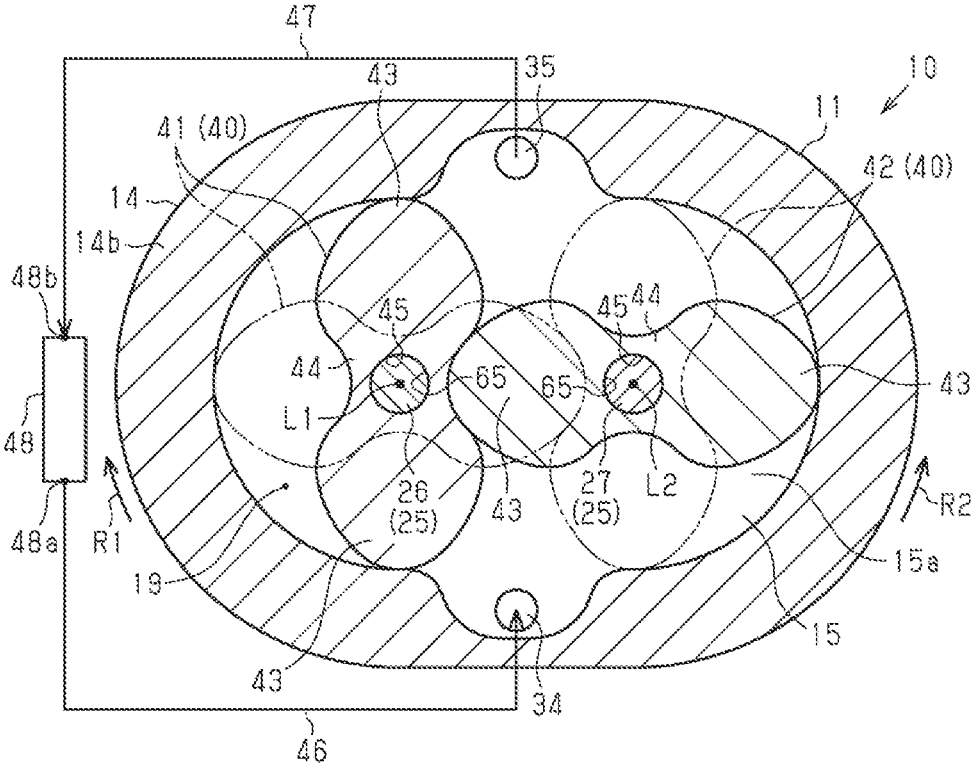
FIG. 2 is a cross-sectional view of the roots pump, taken along the line II-II in FIG. 1.
Figure 3:
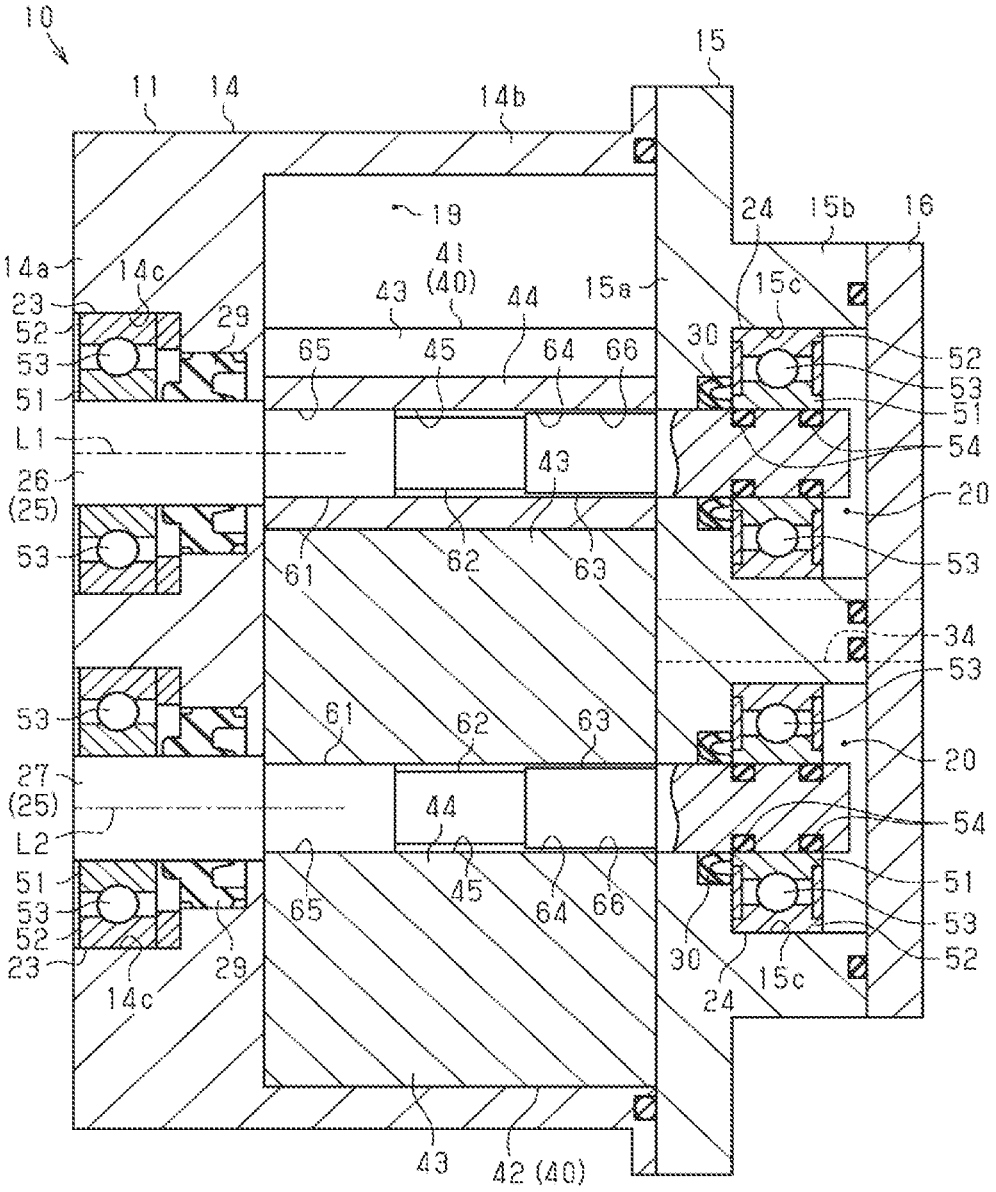
FIG. 3 is a partially enlarged cross-sectional view of the roots pump.

The following will describe an embodiment of a roots pump with reference to accompanying FIGS. 1 to 3. The roots pump of the present embodiment is a hydrogen pump for a fuel cell used in a fuel cell system. The roots pump is mounted on a vehicle, such as a fuel cell vehicle. The roots pump introduces and discharges hydrogen gas as a fluid.

Overall Configuration of Roots Pump 10

As illustrated in FIG. 1, a roots pump 10 includes a housing 11. The housing 11 has a cylindrical shape. The housing 11 is made of a metallic material. The housing 11 is made of aluminum, for example.

The housing 11 includes a first housing member 12, a second housing member 13, a third housing member 14, a fourth housing member 15, and a fifth housing member 16. The first housing member 12, the second housing member 13, the third housing member 14, the fourth housing member 15, and the fifth housing member 16 are integrally assembled to form the housing 11.

The first housing member 12 includes a first end wall 12*a* and a first peripheral wall 12*b*. The first end wall 12*a* has a plate shape. The first peripheral wall 12*b* has a cylindrical shape and extends from the outer peripheral portion of the first end wall 12*a*. The first housing member 12 has a first bearing holding portion 12*c*. The first bearing holding portion 12*c* has a cylindrical shape. The first bearing holding portion 12*c* protrudes from the center portion of the inner surface of the first end wall 12*a* into the first housing member 12.

The second housing member 13 has a second end wall 13*a* and a second peripheral wall 13*b*. The second end wall 13*a* has a plate shape. The second peripheral wall 13*b* has a cylindrical shape and extends from the outer peripheral portion of the second end wall 13*a*. The second housing member 13 is connected to the first housing member 12. The opening of the first peripheral wall 12*b* of the first housing member 12 is closed by the second end wall 13*a*. The second housing member 13 has a pair of second bearing holding portions 13*c*. The pair of second bearing holding portions 13*c* is formed in the second end wall 13*a*. One of the second bearing holding portions 13*c* is a hole that is formed through the second end wall 13*a* in the thickness direction of the second end wall 13*a*. The other of the second bearing holding portions 13*c* is a recess formed in the inner surface of the second end wall 13*a*.

The third housing member 14 has a third end wall 14*a* and a third peripheral wall 14*b*. The third end wall 14*a* has a plate shape. The third peripheral wall 14*b* has a cylindrical shape and extends from the outer peripheral portion of the third end wall 14*a*. The third housing member 14 is connected to the second housing member 13. The opening of the second peripheral wall 13*b* of the second housing member 13 is closed by the third end wall 14*a*. The third housing member 14 has a pair of third bearing holding portions 14*c*. The pair of third bearing holding portions 14*c* is formed in the third end wall 14*a*. The pair of third bearing holding portions 14*c* is holes that are formed through the third end wall 14*a* in the thickness direction of the third end wall 14*a*.

The fourth housing member 15 has a fourth end wall 15*a*, a boss 15*b*, and a pair of fourth bearing holding portions 15*c*. The fourth end wall 15*a* has a plate shape. The fourth housing member 15 is connected to the third housing member 14. The opening of the third peripheral wall 14*b* of the third housing member 14 is closed by the fourth end wall 15*a*. The boss 15*b* has a cylindrical shape. The boss 15*b* protrudes from the fourth end wall 15*a*. The pair of fourth bearing holding portions 15*c* is formed in the boss 15*b*.

The fifth housing member 16 has a plate shape. The fifth housing member 16 is connected to the fourth housing member 15. The opening of the boss 15*b* is closed by the fifth housing member 16.

The roots pump 10 has a motor chamber 17, a gear chamber 18, a rotor chamber 19, and a pair of bearing accommodation chambers 20. The motor chamber 17, the gear chamber 18, the rotor chamber 19, and the pair of bearing accommodation chambers 20 are formed in the housing 11. The motor chamber 17 is defined by the first end wall 12*a*, the first peripheral wall 12*b*, and the second end wall 13*a*. The gear chamber 18 is defined by the second end wall 13*a*, the second peripheral wall 13*b*, and the third end wall 14*a*. Each of the second bearing holding portions 13*c* opens to the gear chamber 18.

The roots pump 10 includes a bearing 21. The bearing 21 is held by the first bearing holding portion 12*c*. The roots pump 10 includes a pair of bearings 22. Each of the bearings 22 is held by the corresponding second bearing holding portion 13*c*. The pair of bearings 22 is located between the motor chamber 17 and the gear chamber 18.

The rotor chamber 19 is defined by the third end wall 14*a*, the third peripheral wall 14*b*, and the fourth end wall 15*a*. That is, the rotor chamber 19 is defined by the third housing member 14 and the fourth housing member 15. The third housing member 14 serves as the first housing component of the present disclosure. The fourth housing member 15 serves as the second housing component of the present disclosure. That is, the housing 11 includes the first housing component and the second housing component. Each of the third bearing holding portions 14*c* opens to the gear chamber 18 and the rotor chamber 19. The pair of third bearing holding portions 14*c* is located between the gear chamber 18 and the rotor chamber 19.

The roots pump 10 includes a pair of first bearings 23 and a pair of second bearings 24. Each of the first bearings 23 is held by the corresponding third bearing holding portion 14*c*. That is, the pair of first bearings 23 is held by the third housing member 14 serving as the first housing component.

The pair of bearing accommodation chambers 20 is defined by the boss 15*b* and the fifth housing member 16. Each of the second bearings 24 is held by the corresponding fourth bearing holding portion 15*c*. That is, the pair of second bearings 24 is held by the fourth housing member 15 serving as the second housing component.

The roots pump 10 includes a rotary shaft 25. The rotary shaft 25 is disposed in the housing 11. The rotary shaft 25 includes a drive shaft 26 and a driven shaft 27. In the following description, the drive shaft 26 and the driven shaft 27 may be simply referred to as the rotary shaft 25.

The drive shaft 26 and the driven shaft 27 are made of a metallic material. The drive shaft 26 and the driven shaft 27 are made of stainless steel, for example. Accordingly, the coefficient of linear expansion of the material of the housing 11 is larger than the coefficient of linear expansion of the material of the rotary shaft 25.

The drive shaft 26 and the driven shaft 27 are arranged in parallel to each other. A direction in which an axis L1 of the drive shaft 26 and an axis L2 of the driven shaft 27 extend serves as the axial direction of the rotary shaft 25. The drive shaft 26 penetrates the second end wall 13*a*, the third end wall 14*a*, and the fourth end wall 15*a*. The driven shaft 27 penetrates the third end wall 14*a* and the fourth end wall 15*a*. The drive shaft 26 is rotatably supported by the housing 11 via the bearing 21, the bearing 22, the first bearing 23, and the second bearing 24. The driven shaft 27 is rotatably supported by the housing 11 via the bearing 22, the first bearing 23, and the second bearing 24.

The roots pump 10 includes a first sealing member 28, a pair of second sealing members 29, and a pair of third sealing members 30. The first sealing member 28 is disposed in the second end wall 13*a*. The first sealing member 28 seals a gap between the drive shaft 26 and the second end wall 13*a*. The pair of second sealing members 29 is disposed in the third end wall 14*a*. One of the second sealing members 29 seals a gap between the drive shaft 26 and the third end wall 14*a*. The other of the second sealing members 29 seals a gap between the driven shaft 27 and the third end wall 14*a*. The pair of third sealing members 30 is disposed in the fourth end wall 15*a*. One of the third sealing members 30 seals a gap between the drive shaft 26 and the fourth end wall 15*a*. The other of the third sealing members 30 seals a gap between the driven shaft 27 and the fourth end wall 15*a*.

The roots pump 10 includes a motor 31. The motor 31 is accommodated in the motor chamber 17. That is, the motor chamber 17 accommodates the motor 31. The motor 31 is connected to the drive shaft 26. The motor 31 rotates the drive shaft 26.

The roots pump 10 includes a drive gear 32 and a driven gear 33. The drive gear 32 and the driven gear 33 are accommodated in the gear chamber 18. The gear chamber 18 accommodates the drive gear 32 and the driven gear 33. The drive gear 32 is fixed to the drive shaft 26. The driven gear 33 is fixed to the driven shaft 27. The driven gear 33 meshes with and rotates together with the drive gear 32. The driven shaft 27 is rotated by the drive gear 32 and the driven gear 33 in the reverse direction of the rotational direction of the drive shaft 26.

As illustrated in FIGS. 1 and 2, the housing 11 has a suction hole 34 and a discharge hole 35. The suction hole 34 and the discharge hole 35 are formed through the fourth housing member 15 and the fifth housing member 16. That is, the fourth housing member 15 serving as the second housing component has the suction hole 34 and the discharge hole 35. The rotor chamber 19 is connected to the suction hole 34 and the discharge hole 35. Hydrogen gas is introduced to the rotor chamber 19 through the suction hole 34. The hydrogen gas is discharged from the rotor chamber 19 through the discharge hole 35.

The roots pump 10 includes a rotor 40. The rotor 40 includes a drive rotor 41 and a driven rotor 42. In the following description, the drive rotor 41 and the driven rotor 42 may be simply referred to as the rotor 40. The drive rotor 41 and the driven rotor 42 are made of a metallic material. The drive rotor 41 and the driven rotor 42 are made of aluminum, for example. Accordingly, the coefficient of linear expansion of the material of the rotor 40 is equal to the coefficient of linear expansion of the material of the housing 11. Therefore, the coefficient of linear expansion of the material of the housing 11 and the coefficient of linear expansion of the material of the rotor 40 are larger than the coefficient of linear expansion of the material of the rotary shaft 25.

As illustrated in FIG. 2, the drive rotor 41 and the driven rotor 42 are accommodated in the rotor chamber 19. The drive rotor 41 and the driven rotor 42 are two-lobe rotors each having two lobes in cross-section perpendicular to the axial direction of the drive shaft 26 and the driven shaft 27. The drive rotor 41 and the driven rotor 42 each have a pair of teeth portions 43 and a shaft supporting portion 44 located between the teeth portions 43.

The shaft supporting portion 44 has an insertion hole 45 and a hole-forming surface 64 that forms the insertion hole 45. That is, each of the drive rotor 41 and the driven rotor 42 as the rotor 40 (i.e., the rotor of the present disclosure) has the insertion hole 45 (i.e., the insertion hole of the present disclosure). The insertion hole 45 is formed through the shaft supporting portion 44. The insertion hole 45 has a constant hole diameter. The drive shaft 26 is inserted through the insertion hole 45 of the drive rotor 41. The driven shaft 27 is inserted through the insertion hole 45 of the driven rotor 42. That is, the rotary shaft 25 is inserted through the insertion hole 45.

The outer peripheral surfaces of the teeth portions 43 form the projections of the rotor 40. The outer peripheral surfaces of the shaft supporting portions 44 form the depressions of the rotor 40. The teeth portions 43 of the drive rotor 41 and the shaft supporting portions 44 of the driven rotor 42 are configured to mesh with each other. The shaft supporting portions 44 of the drive rotor 41 and the teeth portions 43 of the driven rotor 42 are configured to mesh with each other. The pair of teeth portions 43 has a solid structure. The rotor 40 has a solid structure as a whole except for the insertion holes 45. That is, the rotor 40 of the present embodiment has a solid structure as a whole. The drive rotor 41 and the driven rotor 42 are configured so that the drive rotor 41 and the driven rotor 42 mesh with each other. The drive rotor 41 is mounted on the drive shaft 26. The drive rotor 41 rotates together with the drive shaft 26 in the rotor chamber 19. The driven rotor 42 is mounted on the driven shaft 27. The driven rotor 42 rotates together with the driven shaft 27 in the rotor chamber 19. The driven rotor 42 rotates together with the drive rotor 41. The drive rotor 41 rotates in the direction indicated by an arrow R1 in FIG. 2, and the driven rotor 42 rotates in the direction indicated by an arrow R2 in FIG. 2.

The suction hole 34 is connected to a hydrogen outlet 48*a* of a fuel cell 48 via a first connection pipe 46. The discharge hole 35 is connected to a hydrogen inlet 48*b* of the fuel cell 48 via a second connection pipe 47.

When the drive shaft 26 is rotated by the activated motor 31, the drive gear 32 and the driven gear 33 that mesh with each other rotate synchronously. As the drive gear 32 and the driven gear 33 rotate synchronously, the drive shaft 26 and the driven shaft 27 rotate in opposite directions. Accordingly, the drive rotor 41 and the driven rotor 42, which mesh with each other, rotate in the opposite directions. This causes hydrogen gas, which did not react with oxygen in the fuel cell 48, to be introduced to the rotor chamber 19 through the hydrogen outlet 48*a*, the first connection pipe 46, and the suction hole 34 in the roots pump 10. The hydrogen gas introduced to the rotor chamber 19 is discharged through the discharge hole 35 and supplied to the fuel cell 48 through the second connection pipe 47 and the hydrogen inlet 48*b*. Accordingly, the roots pump 10 supplies the hydrogen gas to the fuel cell 48 by the rotation of the drive rotor 41 and the driven rotor 42. In such a way, with the rotation of the drive rotor 41 and the driven rotor 42, the hydrogen gas is introduced to the rotor chamber 19 through the suction hole 34, and discharged from the rotor chamber 19 through the discharge hole 35, in the roots pump 10.

As illustrated in FIG. 3, each of the first bearings 23 and the second bearings 24 includes an inner ring 51, an outer ring 52, and a rolling element 53. The outer ring 52 surrounds the inner ring 51 and is supported by the housing 11. The rolling element 53 is disposed between the inner ring 51 and the outer ring 52. The first bearing 23 and the second bearing 24 of the present embodiment are ball bearings including balls, which, in this embodiment, are the rolling element 53 between the inner ring 51 and the outer ring 52. The first bearing 23 and the second bearing 24 may be roller bearings including rollers serving as the rolling element 53.

One of the first bearings 23 and one of the second bearings 24 support the drive shaft 26 respectively on the opposite sides of the drive rotor 41 so that the drive shaft 26 is rotatable relative to the housing 11. The other of the first bearings 23 and the other of the second bearings 24 support the driven shaft 27 respectively on the opposite sides of the driven rotor 42 so that the driven shaft 27 is rotatable relative to the housing 11. The drive shaft 26 is press-fitted in the inner ring 51 of the one of the first bearings 23, and fitted in the inner ring 51 of the one of the second bearings 24 with a clearance between the drive shaft 26 and the inner ring 51 of the one of the second bearings 24. The driven shaft 27 is press-fitted in the inner ring 51 of the other of the first bearings 23, and fitted in the inner ring 51 of the other of the second bearings 24 with a clearance between the driven shaft 27 and the inner ring 51 of the other of the second bearings 24.

The outer ring 52 of each first bearing 23 is tightly fitted in the corresponding third bearing holding portion 14*c*. The inner rings 51 of the first bearings 23 rotate together with the rotary shaft 25. The outer ring 52 of each second bearing 24 is tightly fitted in the corresponding fourth bearing holding portion 15*c*. O-rings 54 are attached to a portion of the rotary shaft 25 located inside of the inner rings 51 of the second bearings 24. The inner rings 51 of the second bearings 24 rotate together with the rotary shaft 25 via the O-rings 54.

Relationship Between the Rotor 40 and the Rotary Shaft 25

The following will describe the relationship between the rotor 40 and the rotary shaft 25. The relationship between the drive rotor 41 and the drive shaft 26 is almost the same as the relationship between the driven rotor 42 and the driven shaft 27, and will be referred to as and described simply as the relationship between the rotor 40 and the rotary shaft 25.

The drive shaft 26 and the driven shaft 27 (i.e., the rotary shaft 25) each have a large-diameter portion 61, a small-diameter portion 62, and a middle-diameter portion 63. The large-diameter portions 61, the small-diameter portions 62, and the middle-diameter portions 63 of the drive shaft 26 and the driven shaft 27 are a portion located inside of the corresponding insertion holes 45. The outer diameter of each large-diameter portion 61 is larger than the outer diameter of the small-diameter portion 62 and the outer diameter of the middle-diameter portion 63. The outer diameter of the middle-diameter portion 63 is larger than the outer diameter of the small-diameter portion 62. The large-diameter portion 61 is located closer to the first bearing 23 than the small-diameter portion 62 and the middle-diameter portion 63 to the first bearing 23. The insertion hole 45 is formed by the hole-forming surface 64, and the large-diameter portion 61 is press-fitted in an edge portion of the hole-forming surface 64 adjacent to the first bearing 23. Accordingly, the edge portion of the hole-forming surface 64 adjacent to the first bearing 23 serves as a press-fitting portion 65 in which the rotary shaft 25 is press-fitted. The rotor 40 rotates, in the rotor chamber 19, together with the rotary shaft 25 press-fitted in the hole-forming surface 64.

Each middle-diameter portion 63 is continuous to an end of the large-diameter portion 61 distant from the first bearing 23. Each small-diameter portion 62 is continuous to an end of the middle-diameter portion 63 distant from the large-diameter portion 61. The middle-diameter portion 63 is located closer to the second bearing 24 than the large-diameter portion 61 and the small-diameter portion 62 to the second bearing 24. The middle-diameter portion 63 is fitted in an edge portion of the hole-forming surface 64 adjacent to the second bearing 24 with a clearance between the middle-diameter portion 63 of the rotary shaft 25 and the hole-forming surface 64. Accordingly, the edge portion of the hole-forming surface 64 adjacent to the second bearing 24 serves as a clearance-fitting portion 66 in which the rotary shaft 25 is fitted with a clearance between the rotary shaft 25 and the clearance-fitting portion 66. In the roots pump 10 of the present embodiment, only the edge portion of the hole-forming surface 64 adjacent to the second bearing 24 serves as the clearance-fitting portion 66. The clearance between the middle-diameter portion 63 of the rotary shaft 25 and the clearance-fitting portion 66 is smaller than a clearance between the small-diameter portion 62 of the rotary shaft 25 and a part of the hole-forming surface 64 between the press-fitting portion 65 and the clearance-fitting portion 66. The clearance between the clearance-fitting portion 66 and the rotary shaft 25 is determined to prevent an interference between the middle-diameter portion 63 of the rotary shaft 25 and the hole-forming surface 64 when both the rotor 40 and the rotary shaft 25 thermally expand.

Operation

The following will describe the operation of the roots pump according to the present embodiment.

While the roots pump 10 is driven, the housing 11, the rotor 40, and the rotary shaft 25 are affected by heat. For example, the third housing member 14 thermally expands in the axial direction of the rotary shaft 25 from a press-fitting area of the inner ring 51 of the first bearing 23 in which the rotary shaft 25 is press-fitted. The fourth housing member 15 also thermally expands in the axial direction of the rotary shaft 25 following the thermal expansion of the third housing member 14 in the axial direction of the rotary shaft 25. The thermal expansion of the fourth housing member 15 in the axial direction of the rotary shaft 25 is not constrained at a position between the second bearing 24 and the rotary shaft 25 because the rotary shaft 25 is fitted in the inner ring 51 of the second bearing 24 with a clearance between the rotary shaft 25 and the inner ring 51 of the second bearing 24. This prevents a load from being applied on the second bearing 24 when the fourth housing member 15 thermally expands in the axial direction of the rotary shaft 25.

The rotor 40 and the rotary shaft 25 thermally expand in the axial direction of the rotary shaft 25, so that the rotor 40 is displaced in the axial direction of the rotary shaft 25. Since the rotary shaft 25 is press-fitted in the hole-forming surface 64, the amount of displacement of the rotor 40 due to the thermal expansion depends on the thermal expansion of the rotary shaft 25 in the axial direction of the rotary shaft 25. A region where the rotor 40 thermally expands in the axial direction of the rotary shaft 25 depending on the thermal expansion of the rotary shaft 25 extends with an increase in the distance between the press-fitting area of the inner ring 51 of the first bearing 23 in which the rotary shaft 25 is press-fitted and the press-fitting portion 65 of the hole-forming surface 64.

The edge portion of the hole-forming surface 64 adjacent to the first bearing 23 serves as the press-fitting portion 65. This configuration may minimize the distance between the press-fitting area of the inner ring 51 of the first bearing 23 in which the rotary shaft 25 is press-fitted and the press-fitting portion 65 of the hole-forming surface 64, thereby reducing the region where the rotor 40 thermally expands in the axial direction of the rotary shaft 25 depending on the thermal expansion of the rotary shaft 25 in the axial direction. This configuration therefore decreases the difference between the displacement amount of the third housing member 14 and the displacement amount of the rotor 40 in the axial direction of the rotary shaft 25 due to the thermal expansion. This configuration is therefore likely to prevent an excessive increase in the clearance between the rotor 40 and the fourth housing member 15 or a contact of the rotor 40 with the third end wall 14*a* of the third housing member 14.

According to the present embodiment, the edge portion of the hole-forming surface 64 adjacent to the first bearing 23 serves as the press-fitting portion 65 in which the rotary shaft 25 is press-fitted. This configuration may cause a pressure of the hydrogen gas to act on the rotor 40, thereby causing a deformation of the rotor 40 in the radially inward direction of the rotary shaft 25 from the press-fitting portion 65. However, the edge portion of the hole-forming surface 64 adjacent to the second bearing 24 serves as the clearance-fitting portion 66 in which the rotary shaft 25 is fitted with a clearance between the rotary shaft 25 and the clearance-fitting portion 66. This configuration minimizes the clearance between the rotary shaft 25 and the edge portion of the hole-forming surface 64 adjacent to the second bearing 24. This configuration therefore reduces the deformation of the rotor 40 in the radially inward direction of the rotary shaft 25 from the press-fitting portion 65, even if a pressure of the hydrogen gas acts on the rotor 40. This configuration is therefore likely to prevent an excessive increase in the clearance between the rotor 40 and the third peripheral wall 14*b* of the third housing member 14.

Advantageous Effects

The aforementioned embodiment provides the following advantageous effects.

(1) The edge portion of the hole-forming surface 64 adjacent to the first bearing 23 serves as the press-fitting portion 65 in which the rotary shaft 25 is press-fitted. This configuration may minimize the distance between the press-fitting area of the inner ring 51 of the first bearing 23 in which the rotary shaft 25 is press-fitted and the press-fitting portion 65 of the hole-forming surface 64, thereby reducing the region where the rotor 40 thermally expands in the axial direction depending on the thermal expansion of the rotary shaft 25 in the axial direction. This configuration therefore decreases the difference between the displacement amount of the housing 11 and the displacement amount of the rotor 40 in the axial direction of the rotary shaft 25 due to the thermal expansion. This configuration is therefore likely to prevent an excessive increase in the clearance between the rotor 40 and the housing 11 or a contact of the rotor 40 with the housing 11.

According to the present embodiment, the edge portion of the hole-forming surface 64 adjacent to the first bearing 23 serves as the press-fitting portion 65 in which the rotary shaft 25 is press-fitted. This configuration may cause a pressure of the hydrogen gas to act on the rotor 40, thereby causing a deformation of the rotor 40 in the radially inward direction of the rotary shaft 25 from the press-fitting portion 65. If the rotor 40 deforms in the radially inward direction of the rotary shaft 25 from the press-fitting portion 65, the clearance between the rotor 40 and the housing 11 may increase excessively and the performance of the roots pump 10 may therefore decrease.

However, the edge portion of the hole-forming surface 64 adjacent to the second bearing 24 serves as the clearance-fitting portion 66 in which the rotary shaft 25 is fitted with a clearance between the rotary shaft 25 and the clearance-fitting portion 66. This configuration may minimize the clearance between the rotary shaft 25 and the edge portion of the hole-forming surface 64 adjacent to the second bearing 24. This configuration may therefore reduce the deformation of the rotor 40 in the radially inward direction of the rotary shaft 25 from the press-fitting portion 65, even if a pressure of the hydrogen gas acts on the rotor 40. This configuration therefore prevents an excessive increase in the clearance between the rotor 40 and the housing 11. Accordingly, this configuration increases the performance of the roots pump 10.

(2) According to the present embodiment, only the edge portion of the hole-forming surface 64 adjacent to the second bearing 24 serves as the clearance-fitting portion 66. This configuration facilitates control of the clearance between the rotary shaft 25 and the edge portion of the hole-forming surface 64 adjacent to the second bearing 24. This configuration therefore allows minimization of the clearance between the rotary shaft 25 and the edge portion of the hole-forming surface 64 adjacent to the second bearing 24. This configuration therefore allows reduction of the deformation of the rotor 40 in the radially inward direction of the rotary shaft 25 from the press-fitting portion 65, even if a pressure of the hydrogen gas acts on the rotor 40.

(3) The rotor 40 has a solid structure as a whole. This configuration increases the whole stiffness of the rotor 40, and is therefore likely to prevent the deformation of the rotor 40. This configuration is likely to prevent an interference between the rotor 40 and the housing 11 due to the deformation of the rotor 40 in the radially outward direction of the rotary shaft 25, which may be caused by the press-fitting of the rotary shaft 25 in the press-fitting portion 65.

(4) The fourth housing member 15 has the suction hole 34 and the discharge hole 35, so that the temperature of the fourth housing member 15 is likely to be higher than the temperature of the third housing member 14 due to the introduction and the discharge of the hydrogen gas. Accordingly, the fourth housing member 15 is more likely to thermally expand than the third housing member 14. According to the present embodiment, the first bearing 23 is held by the third housing member 14. The inner ring 51 of the first bearing 23 needs to have a press-fitting margin considering the displacement amount of the third housing member 14 due to the thermal expansion. The displacement amount of the third housing member 14 due to the thermal expansion is smaller than the displacement amount of the fourth housing member 15 due to the thermal expansion. This allows a press-fitting margin for the inner ring 51 of the first bearing 23 to be easily secured. Accordingly, the configuration of the roots pump 10 in which the first bearing 23 and the second bearing 24 are respectively held by the third housing member 14 (i.e., the first housing component)

and the fourth housing member 15 (i.e., the second housing component) facilitates designing of the roots pump 10.

Modification

The aforementioned embodiment may be modified as below. The embodiment and the following modifications may be combined with each other within technically consistent range.

Figure 4:
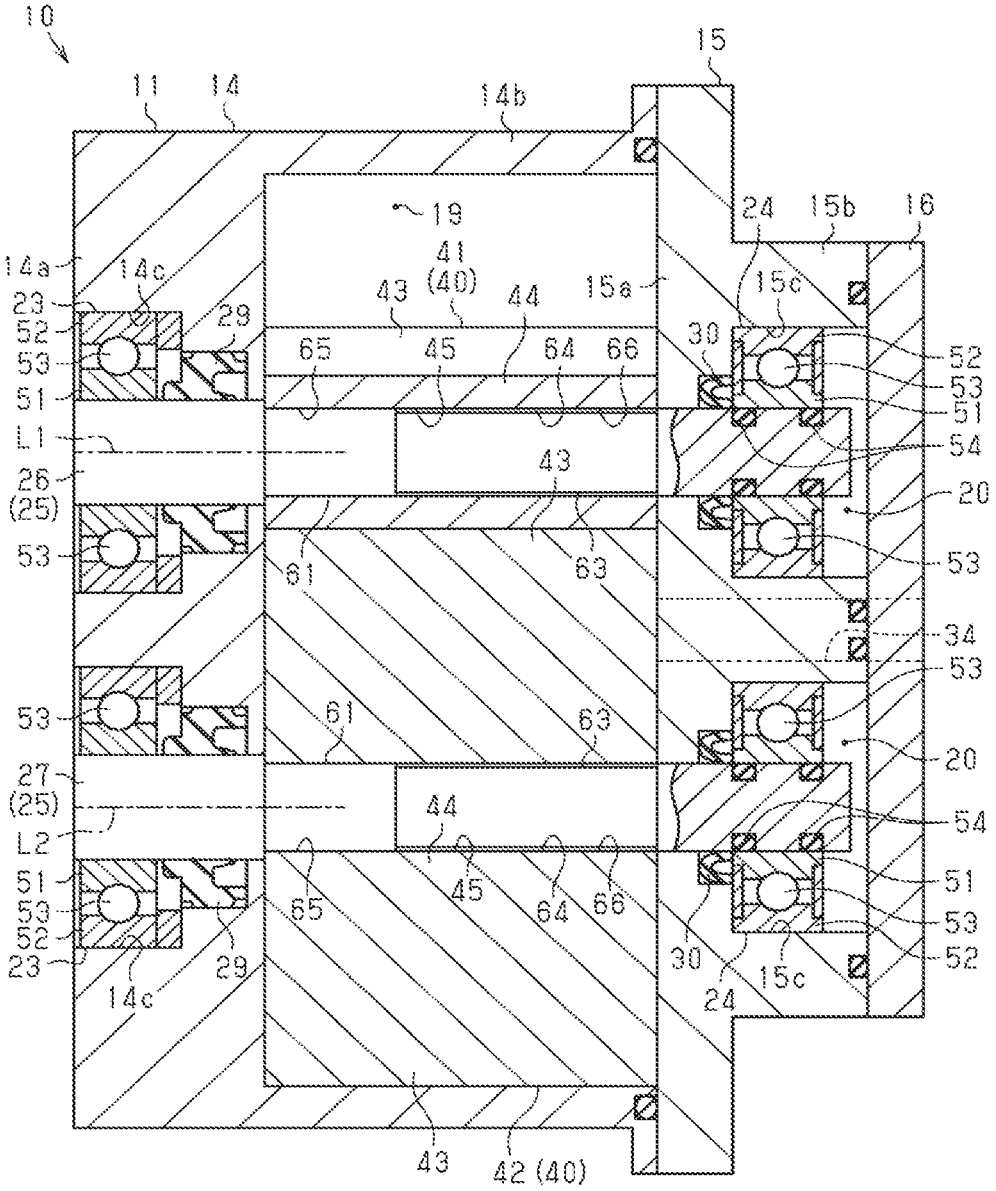
FIG. 4 is a partially enlarged cross-sectional view of a roots pump according to another embodiment.

As shown in FIG. 4, the hole-forming surface 64, except for the edge portion of the hole-forming surface 64 serving as the press-fitting portion 65, may serve as the clearance-fitting portion 66. That is, at least the edge portion of the hole-forming surface 64 adjacent to the second bearing 24 serves as the clearance-fitting portion 66 in which the rotary shaft 25 is fitted with a clearance between the rotary shaft 25 and the clearance-fitting portion 66. The configuration in which the hole-forming surface 64, except for the edge portion of the hole-forming surface 64 serving as the press-fitting portion 65, serves as the clearance-fitting portion 66 facilitates machining of the hole-forming surface 64 or the outer peripheral surface of the rotary shaft 25. This therefore allows simplification of the configuration of the roots pump 10.

Figure 5:
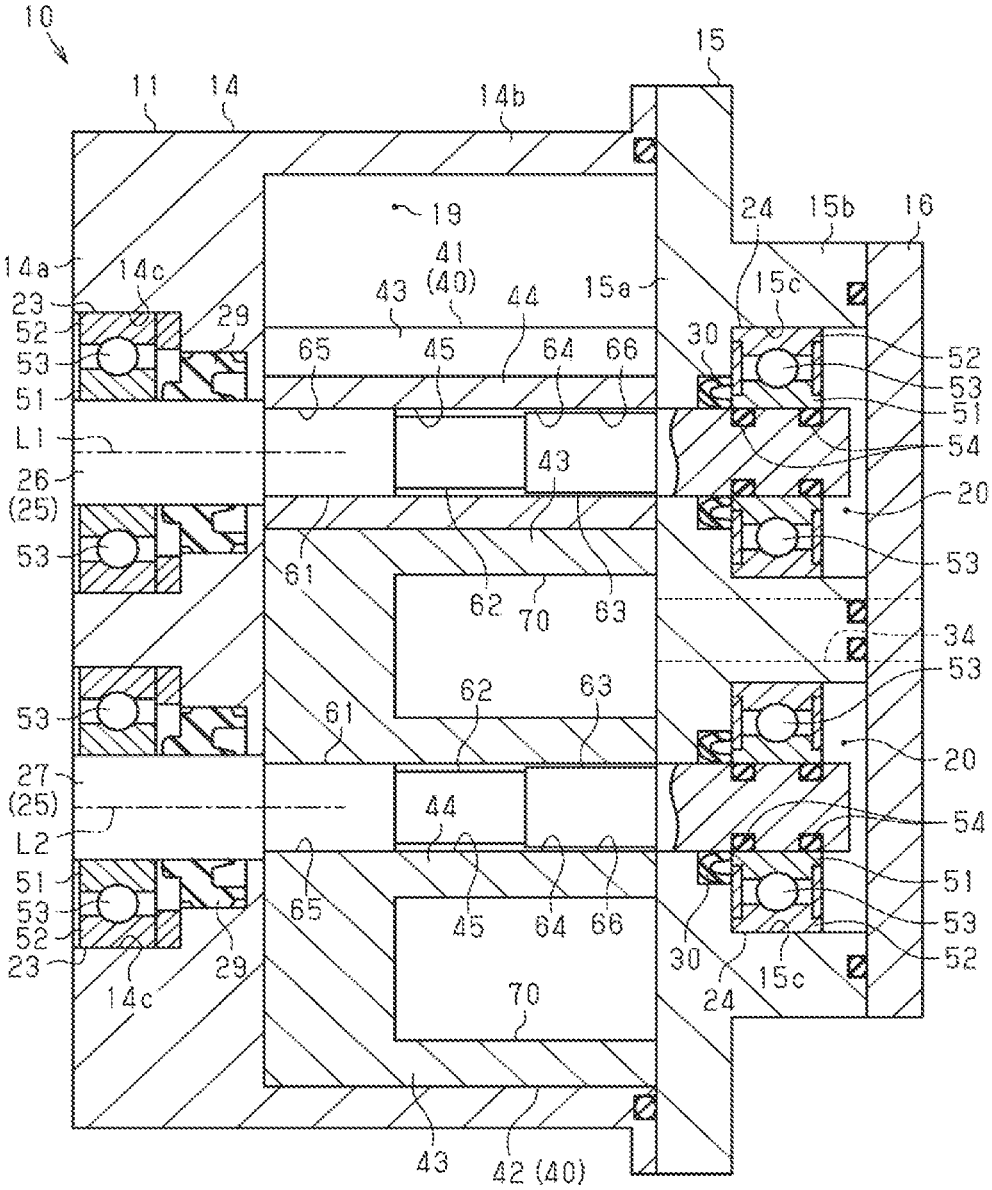
FIG. 5 is a partially enlarged cross-sectional view of a roots pump according to another embodiment.

As illustrated in FIG. 5, the rotor 40 may have a solid structure only in a portion of the rotor 40 overlapping the press-fitting portion 65 in the radial direction of the rotary shaft 25. According to this modification, the rotor 40 has a recess 70. The recess 70 is formed in each of the teeth portions 43. The recess 70 opens on the end face of the rotor 40 adjacent to the fourth housing member 15. The recess 70 is formed in a part of the teeth portion 43 overlapping the middle-diameter portion 63 and the small-diameter portion 62 of the rotary shaft 25 in the radial direction of the rotary shaft 25. The rotor 40 has a solid structure in the portion of the rotor 40 overlapping the press-fitting portion 65 in the radial direction of the rotary shaft 25. This configuration suppresses the deformation of the portion of the rotor 40 overlapping the press-fitting portion 65 in the radial direction of the rotary shaft 25. This configuration is therefore likely to prevent an interference between the rotor 40 and the housing 11 due to the deformation of the rotor 40 in the radially outward direction of the rotary shaft 25, which may be caused by the press-fitting of the rotary shaft 25 in the press-fitting portion 65. Additionally, this configuration reduces the weight of the rotor 40, compared with a configuration of the rotor 40 having a solid structure as a whole. This configuration therefore reduces inertia of the rotor 40.

Figure 6:
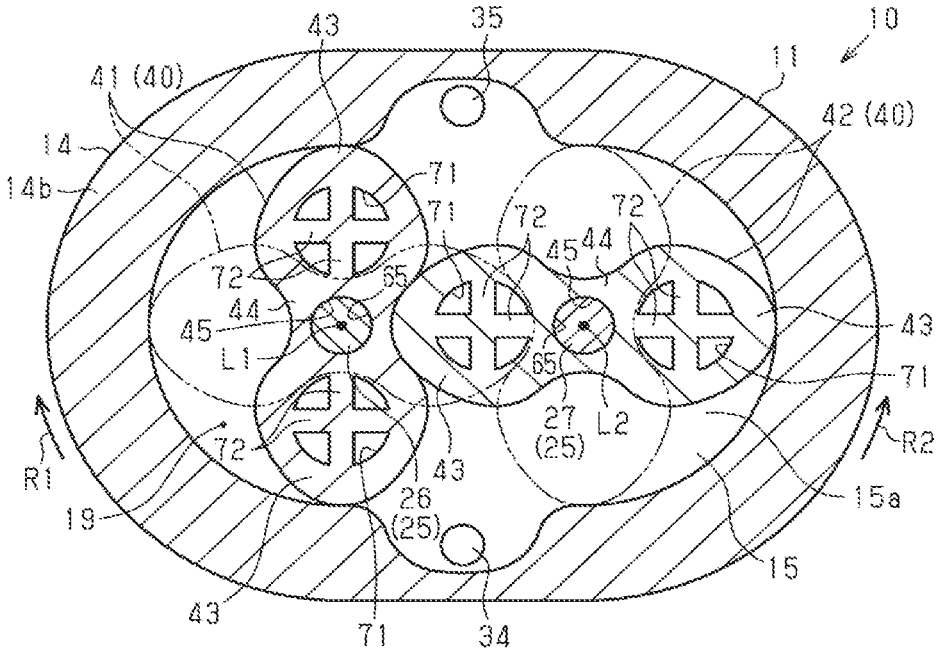
FIG. 6 is a cross-sectional view of a roots pump according to another embodiment.

As illustrated in FIG. 6, the rotor 40 may have a through hole 71 formed through the rotor 40 and located outward of the insertion hole 45 in the radial direction of the rotary shaft 25. The rotor 40 may have a rib 72 in the through hole 71 at a position overlapping the press-fitting portion 65 in the radial direction of the rotary shaft 25. The through hole 71 is formed in each of the teeth portions 43. This configuration suppresses the deformation of the portion of the rotor 40 overlapping the press-fitting portion 65 in the radial direction of the rotary shaft 25. This configuration is therefore likely to prevent an interference between the rotor 40 and the housing 11 due to the deformation of the rotor 40 in the radially outward direction of the rotary shaft 25, which may be caused by the press-fitting of the rotary shaft 25 in the press-fitting portion 65. The through hole 71 is formed through the rotor 40. This configuration suppresses foreign matter in the rotor chamber 19 from accumulating in the through hole 71. Accordingly, this configuration therefore suppresses an increase in the weight of the rotor 40. This configuration therefore reduces inertia of the rotor 40.

In the aforementioned embodiment, the portion of the rotary shaft 25 located inside of the insertion hole 45 may have a constant diameter. In this configuration, the insertion hole 45 may have a small diameter in the vicinity of the first bearing 23 and a large diameter in the vicinity of the second bearing 24. Accordingly, the edge portion of the hole-forming surface 64 adjacent to the first bearing 23 may serve as the press-fitting portion 65, and the edge portion of the hole-forming surface 64 adjacent to the second bearing 24 may serve as the clearance-fitting portion 66.

In the aforementioned embodiment, the first bearing 23 may be held by the fourth housing member 15 and the second bearing 24 may be held by the third housing member 14.

In the aforementioned embodiment, the suction hole 34 and the discharge hole 35 may be formed in the third peripheral wall 14*b* of the third housing member 14, for example.

In the aforementioned embodiment, the drive rotor 41 and the driven rotor 42 may be three-lobe rotors each having three lobes in cross-section perpendicular to the axial direction of the drive shaft 26 and the driven shaft 27, for example.

In the aforementioned embodiment, the roots pump 10 may not be mounted on the fuel cell vehicle. That is, the roots pump 10 is not limited to roots pumps mounted on a vehicle.

In the aforementioned embodiment, the roots pump 10 needs a configuration that introduces and discharges a fluid, but may not be a hydrogen pump for a fuel cell used in the fuel cell system.

The aforementioned embodiment includes configurations described in the following notes.

Note 1

A roots pump comprising:

a housing having a suction hole through which a fluid is introduced and a discharge hole through which the fluid is discharged;

a rotor chamber formed in the housing and connected to the suction hole and the discharge hole;

a rotary shaft disposed in the housing;

a rotor having an insertion hole through which the rotary shaft is inserted and a hole-forming surface that forms the insertion hole, the rotor being configured to rotate, in the rotor chamber, together with the rotary shaft press-fitted in the hole-forming surface; and a first bearing and a second bearing supporting the rotary shaft respectively on opposite sides of the rotor so that the rotary shaft is rotatable relative to the housing, each of the first bearing and the second bearing including:

an inner ring;

an outer ring surrounding the inner ring and supported by the housing; and a rolling element disposed between the inner ring and the outer ring, wherein the rotary shaft is press-fitted in the inner ring of the first bearing, and fitted in the inner ring of the second bearing with a clearance between the rotary shaft and the inner ring of the second bearing, a coefficient of linear expansion of a material of the housing and a coefficient of linear expansion of a material of the rotor are larger than a coefficient of linear expansion of a material of the rotary shaft, and a rotation of the rotor causes the fluid to be introduced to the rotor chamber through the suction hole and discharged from the rotor chamber through the discharge hole, wherein an edge portion of the hole-forming surface adjacent to the first bearing serves as a press-fitting portion in which the rotary shaft is press-fitted, and at least an edge portion of the hole-forming surface adjacent to the second bearing serves as a clearance-fitting portion in which the rotary shaft is fitted with a clearance between the rotary shaft and the clearance-fitting portion.

Note 2

The roots pump according to note 1, wherein only the edge portion of the hole-forming surface adjacent to the second bearing serves as the clearance-fitting portion, and the clearance between the rotary shaft and the clearance-fitting portion is smaller than a clearance between the rotary shaft and a part of the hole-forming surface between the press-fitting portion and the clearance-fitting portion.

Note 3

The roots pump according to note 1, wherein the hole-forming surface, except for the edge portion of the hole-forming surface serving as the press-fitting portion, serves as the clearance-fitting portion.

Note 4

The roots pump according to any one of notes 1 to 3, wherein the rotor has a solid structure as a whole.

Note 5

The roots pump according to any one of notes 1 to 3, wherein the rotor has a solid structure only in a portion of the rotor overlapping the press-fitting portion in a radial direction of the rotary shaft.

Note 6

The roots pump according to any one of notes 1 to 3, wherein the rotor has:

a through hole formed through the rotor and located outward of the insertion hole in a radial direction of the rotary shaft; and a rib in the through hole at a position overlapping the press-fitting portion in the radial direction of the rotary shaft.

Note 7

The roots pump according to any one of notes 1 to 6, wherein the housing includes a first housing component and a second housing component, the rotor chamber is defined by the first housing component and the second housing component, the second housing component has the suction hole and the discharge hole, the first bearing is held by the first housing component, and the second bearing is held by the second housing component.

What is claimed is:

1. A roots pump comprising:

a housing having a suction hole through which a fluid is introduced and a discharge hole through which the fluid is discharged;

a rotor chamber formed in the housing and connected to the suction hole and the discharge hole;

a rotary shaft disposed in the housing;

a rotor having an insertion hole through which the rotary shaft is inserted and a hole-forming surface that forms the insertion hole, the rotor being configured to rotate, in the rotor chamber, together with the rotary shaft press-fitted in the hole-forming surface; and a first bearing and a second bearing supporting the rotary shaft respectively on opposite sides of the rotor so that the rotary shaft is rotatable relative to the housing, each of the first bearing and the second bearing including:

an inner ring;

an outer ring surrounding the inner ring and supported by the housing; and a rolling element disposed between the inner ring and the outer ring, wherein the rotary shaft is press-fitted in the inner ring of the first bearing, and fitted in the inner ring of the second bearing with a clearance between the rotary shaft and the inner ring of the second bearing, a coefficient of linear expansion of a material of the housing and a coefficient of linear expansion of a material of the rotor are larger than a coefficient of linear expansion of a material of the rotary shaft, and a rotation of the rotor causes the fluid to be introduced to the rotor chamber through the suction hole and discharged from the rotor chamber through the discharge hole, wherein an edge portion of the hole-forming surface adjacent to the first bearing serves as a press-fitting portion in which the rotary shaft is press-fitted, and at least an edge portion of the hole-forming surface adjacent to the second bearing serves as a clearance-fitting portion in which the rotary shaft is fitted with a clearance between the rotary shaft and the clearance-fitting portion, wherein only the edge portion of the hole-forming surface adjacent to the second bearing serves as the clearance-fitting portion, and the clearance between the rotary shaft and the clearance fitting portion is smaller than a clearance between the rotary shaft and a part of the hole-forming surface between the press-fitting portion and the clearance-fitting portion.

2. The roots pump according to claim 1, wherein the hole-forming surface, except for the edge portion of the hole-forming surface serving as the press-fitting portion, serves as the clearance-fitting portion.

3. The roots pump according to claim 1, wherein the rotor has a solid structure as a whole.

4. The roots pump according to claim 1, wherein the rotor has a solid structure only in a portion of the rotor overlapping the press-fitting portion in a radial direction of the rotary shaft.

5. The roots pump according to claim 1, wherein the housing includes a first housing component and a second housing component, the rotor chamber is defined by the first housing component and the second housing component, the second housing component has the suction hole and the discharge hole, the first bearing is held by the first housing component, and the second bearing is held by the second housing component.

6. The roots pump according to claim 1, wherein the rotor has:

a through hole formed through the rotor and located outward of the insertion hole in a radial direction of the rotary shaft; and a rib in the through hole at a position overlapping the press-fitting portion in the radial direction of the rotary shaft.

7. A roots pump comprising:

a housing having a suction hole through which a fluid is introduced and a discharge hole through which the fluid is discharged;

a rotor chamber formed in the housing and connected to the suction hole and the discharge hole;

a rotary shaft in the housing;

a rotor having an insertion hole through which the rotary shaft is inserted and a hole-forming surface that forms the insertion hole, the rotor being configured to rotate, in the rotor chamber, together with the rotary shaft press-fitted in the hole-forming surface; and a first bearing and a second bearing supporting the rotary shaft respectively on opposite sides of the rotor so that the rotary shaft is rotatable relative to the housing, each of the first bearing and the second bearing including, an inner ring;

an outer ring surrounding the inner ring and supported by the housing; and a rolling element disposed between the inner ring and the outer ring, wherein the rotary shaft is press-fitted in the inner ring of the first bearing, and fitted in the inner ring of the second bearing with a clearance between the rotary shaft and the inner ring of the second bearing, a coefficient of linear expansion of a material of the housing and a coefficient of linear expansion of a material of the rotor are larger than a coefficient of linear expansion of a material of the rotary shaft, and a rotation of the rotor causes the fluid to be introduced to the rotor chamber through the suction hole and discharge from the rotor chamber through the discharge hole, wherein an edge portion of the hole-forming surface adjacent to the first bearing serves as a press-fitting portion in which the rotary shaft is press-fitted, and at least an edge portion of the hole-forming surface adjacent to the second bearing serves as a clearance-fitting portion in which the rotary shaft is fitted with a clearance between the rotary shaft and the clearance-fitting portion, wherein the rotor has:

a through hole formed through the rotor and located outward of the insertion hole in a radial direction of the rotary shaft; and a rib in the through hole at a position overlapping the press-fitting portion in the radial direction of the rotary shaft.

* * * * *